US011613989B2

(12) United States Patent
Zhang et al.

(10) Patent No.: US 11,613,989 B2
(45) **Date of Patent: *Mar. 28, 2023**

(54) SYSTEMS AND METHODS FOR DIFFERENTIATING NON-RADIOACTIVE TRACERS DOWNHOLE

(71) Applicant: CARBO CERAMICS INC., Houston, TX (US)

(72) Inventors: Jeremy Zhang, Katy, TX (US); Harry D. Smith, Jr., Spring, TX (US)

(73) Assignee: CARBO CERAMICS INC., Houston, TX (US)

( * ) Notice: Subject to any disclaimer, the term of this patent is extended or adjusted under 35 U.S.C. 154(b) by 21 days.

This patent is subject to a terminal disclaimer.

(21) Appl. No.: 17/329,264

(22) Filed: May 25, 2021

(65) Prior Publication Data

US 2021/0285320 A1 Sep. 16, 2021

Related U.S. Application Data

(63) Continuation of application No. 16/167,278, filed on Oct. 22, 2018, now Pat. No. 11,015,437.

(51) Int. Cl.

| | |
|---|---|
| ***E21B 47/09*** | (2012.01) |
| ***E21B 47/11*** | (2012.01) |
| ***E21B 47/053*** | (2012.01) |
| *E21B 43/267* | (2006.01) |

(52) U.S. Cl.
CPC ..... *E21B 47/11* (2020.05); *E21B 47/053* (2020.05); *E21B 47/09* (2013.01); *E21B 43/267* (2013.01)

(58) Field of Classification Search
None
See application file for complete search history.

(56) References Cited

U.S. PATENT DOCUMENTS

| | | | |
|---|---|---|---|
| 10,655,445 | B2 | 5/2020 | Zhang et al. |
| 11,015,437 | B2 | 5/2021 | Zhang et al. |
| 2012/0080588 | A1 | 4/2012 | Smith, Jr. et al. |
| 2016/0024909 | A1 | 1/2016 | Han et al. |
| 2017/0329041 | A1 | 11/2017 | Zhang et al. |

*Primary Examiner* — Andrew Sue-Ako
(74) *Attorney, Agent, or Firm* — Patterson + Sheridan, LLP

(57) ABSTRACT

A method for evaluating induced fractures in a wellbore includes obtaining a first set of data in a wellbore using a downhole tool. The method also includes pumping a first proppant into the wellbore after the first set of data is obtained. The first proppant includes a first tracer that is not radioactive. The method also includes pumping a second proppant into the wellbore. The second proppant includes a second tracer that is not radioactive. The second tracer is different than the first tracer. The first proppant and the second proppant flow into fractures in the wellbore. The method also includes obtaining a second set of data in the wellbore using the downhole tool after the first and second proppants are pumped into the wellbore. The method also includes comparing the first and second sets of data.

20 Claims, 5 Drawing Sheets

SYSTEMS AND METHODS FOR DIFFERENTIATING NON-RADIOACTIVE TRACERS DOWNHOLE

CROSS-REFERENCE TO RELATED APPLICATION

This present application is a continuation application that claims priority to U.S. patent application Ser. No. 16/167,278, filed Oct. 22, 2018, and the entire disclosure of which is hereby incorporated for reference.

TECHNICAL FIELD

The present disclosure utilizes two (or more) non-radioactive tracers to evaluate downhole formation fractures, gravel packs, fracture packs, and/or cement. More particularly, the present disclosure differentiates a first downhole scenario from a second downhole scenario. In the first scenario, only one proppant tagged with a non-radioactive tracer (NRT) is present. In the second scenario, a mixture of two proppants, each tagged with a different NRT, is present. The systems and methods disclosed can identify and distinguish each of the non-radioactive tracers in both the first and second scenarios.

BACKGROUND

Recently, non-radioactive tracers (NRTs) have been implemented in induced fractures, gravel packs, fracture packs, and cement. The non-radioactive tracers may be used to tag a proppant or other material that is pumped into a wellbore during a completion procedure. The tagged proppant is traditionally evaluated one of two different ways. The first method utilizes detector count rates of the tagged proppant using a compensated neutron (CNT) logging tool, or utilizes count rates and/or the decay parameters of pulsed neutrons in the formation and borehole region using a pulsed neutron capture (PNC) logging tool, to locate the tagged proppant in the wellbore region and/or in induced fractures in fracturing, gravel pack, frac-pack, and cementing operations. In general, a log is run before and after the completion procedure, and the data in the two (i.e., before and after) logs is compared. The second method measures capture gamma ray spectroscopy using a PNC logging tool and spectrally resolves the capture gamma rays emanating from the tagged proppant from the capture gamma rays emanating from other downhole elements. These techniques are disclosed in U.S. Pat. Nos. 8,100,177, 8,648,309, 8,805,615, 9,038,715.

Conventional systems and methods can differentiate non-radioactive tracers in completion processes if only one tracer-tagged proppant is present in all or part of a pack region (e.g., a fracture). For example, a user may analyze changes of the capture gamma ray count rate log (or capture-to-inelastic ratio C/I log or inelastic-to-capture ratio I/C log) in an early time window and the count rate log (or C/I log or I/C log) in a later time window, borehole sigma logs, formation sigma logs, and/or gadolinium (Gd) yield logs to differentiate whether a Gd-tagged proppant or a boron (B)-tagged proppant is present in a region. However, it is not currently possible to differentiate a Gd-tagged proppant from a mixture of a Gd-tagged proppant and a B-tagged proppant (especially if the percentage of B-tagged proppant is low), as the log responses are similar for the two scenarios. For example, after-completion borehole sigma logs, count rate logs (or I/C logs) in an early time window, Gd yield logs, and/or formation sigma logs may increase relative to the corresponding before-procedure measurements, whereas count rate logs (or C/I logs) in a late time window may decrease.

BRIEF SUMMARY

A method for evaluating induced fractures in a wellbore is disclosed. The method includes obtaining a first set of data in a wellbore using a downhole tool. The method also includes pumping a first proppant into the wellbore after the first set of data is obtained. The first proppant includes a first tracer that is not radioactive. The method also includes pumping a second proppant into the wellbore. The second proppant includes a second tracer that is not radioactive. The second tracer is different than the first tracer. The first proppant and the second proppant flow into fractures in the wellbore. The method also includes obtaining a second set of data in the wellbore using the downhole tool after the first and second proppants are pumped into the wellbore. The method also includes comparing the first and second sets of data.

A method for evaluating a gravel pack or cement in a wellbore is also disclosed. The method includes obtaining a first set of data in a wellbore using a downhole tool. The method also includes pumping a first proppant into the wellbore after the first set of data is obtained. The first proppant includes a first tracer that is not radioactive. The method also includes pumping a second proppant into the wellbore. The second proppant includes a second tracer that is not radioactive. The second tracer is different than the first tracer. The first proppant and the second proppant flow into a gravel pack or cement in the wellbore. The method also includes obtaining a second set of data in the wellbore using the downhole tool after the first and second proppants are pumped into the wellbore. The method also includes comparing the first and second sets of data.

BRIEF DESCRIPTION OF THE DRAWINGS

The present invention may best be understood by referring to the following description and accompanying drawings that are used to illustrate embodiments of the invention. In the drawings.

DETAILED DESCRIPTION

The present disclosure is directed to systems and methods for differentiating a first downhole scenario from a second downhole scenario using data captured by a downhole tool (e.g., a pulsed neutron capture (PNC) tool). In the first scenario, a single NRT-tagged proppant is present. In the second scenario, a combination/mixture of a first NRT-tagged proppant and a second NRT-tagged proppant is present. For example, the systems and methods may differentiate a gadolinium (Gd)-tagged proppant from a combination/mixture of the Gd-tagged proppant and a boron (B)-tagged proppant, even if the percentage of the B-tagged proppant is low (i.e., with respect to the percentage of Gd-tagged proppant). In another example, the systems and methods may differentiate a samarium (Sm)-tagged proppant from a combination/mixture of the Sm-tagged proppant and a boron (B)-tagged proppant, even if the percentage of the B-tagged proppant is low. The percentage (e.g., of the B-tagged proppant) in the mixture may be low when the percentage is less than or equal to about 50%, less than or equal to about 40%, less than or equal to about 30%, less than or equal to about 20%, or less than or equal to about 10%. Conversely, the percentage (e.g., of the B-tagged proppant) in the mixture may be high when the percentage greater than about 50%, greater than about 60%, greater than about 70%, greater than about 80%, or greater than about 90%.

Figure 1:
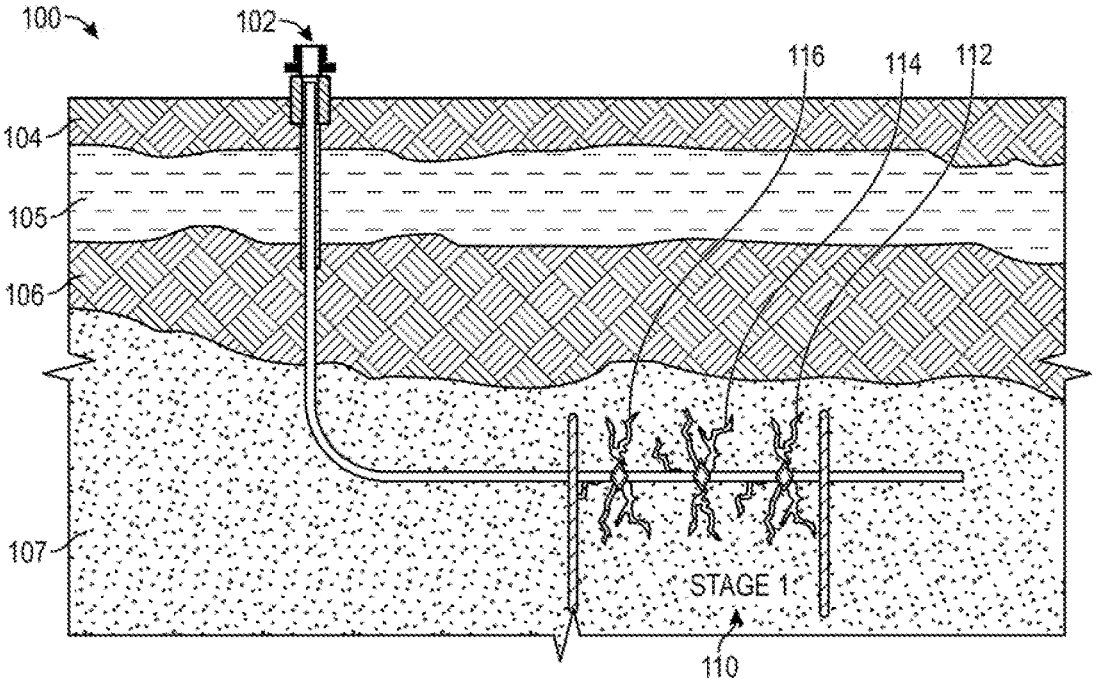
FIG. 1 illustrates a schematic view of a fracturing treatment in a wellbore, according to an embodiment.

FIG. 1 illustrates a schematic view of a wellsite 100 including a fracturing treatment in a wellbore 102, according to an embodiment. The wellbore 102 may extend into a subterranean formation having one or more layers. In the example shown in FIG. 1, the wellbore 102 may include a substantially vertical portion that extends downward through a first formation layer 104, a second formation layer 105, a third formation layer 106, and a reservoir layer 107. The wellbore 102 may also include a substantially horizontal portion (e.g., in the reservoir layer 107).

The wellbore 102 may be cased or uncased. The wellbore 102 may also be perforated and/or fractured in one or more stages. In the example shown in FIG. 1, the horizontal portion of the wellbore 102 may be perforated and/or fractured in a first stage 110. The first stage 110 may include one or more sets of perforations (three are shown: 112, 114, 116). The perforations 112, 114, 116 may be axially-offset from one another with respect to a central longitudinal axis through the wellbore 102. For example, the first set of perforations 112 may be positioned below (e.g., farther from the origination point of the wellbore 102 than) the second set of perforations 114, and the second set of perforations 114 may be positioned below the third set of perforations 116. The first set of perforations 112 may be generated before or at the same time as the second set of perforations 114, and the second set of perforations 114 may be generated before or at the same time as the third set of perforations 116.

After the perforations 112, 114, 116 are formed, one or more fracturing procedures may be initiated. The fracturing procedures may each include pumping a proppant tagged with a non-radioactive tracer into the wellbore 102. These proppants may also be referred to as "non-radioactive tracer-tagged proppants" and/or "NRT-tagged proppants," which include a tracer material that is not radioactive and has a high thermal neutron capture cross-section.

In at least one embodiment, the fracturing procedures may be initiated/performed sequentially. For example, one NRT-tagged proppant may be placed in one perforation 112 and/or stage of a frac job, and another NRT-tagged proppant may be placed in a subsequent perforation 114 and/or stage. In another example, the fracturing procedures may instead be initiated/performed simultaneously. For example, one NRT may be used to tag proppant particles of one size, and that NRT-tagged proppant may be mixed, prior to being pumped downhole, with the proppant particles of a different size that are tagged with another NRT.

The tracer in a first NRT-tagged proppant may be or include gadolinium (Gd) or samarium (Sm). For example, the tracer may be or include $Gd_2O_3$ or $Sm_2O_3$. The tracer in a second NRT-tagged proppant may be different from the tracer in the first NRT-tagged proppant. The tracer in the second NRT-tagged proppant may be or include boron (B). For example, the tracer may be or include $B_4C$. In one or more embodiments, the NRT-tagged proppant, as used herein, may be supplemented with or replaced with loose NRT material that is separate and distinct from any proppant or other carrier material(s). For example, raw boron carbide may be mixed with any fracturing fluid, gravel pack fluid, cement, gravel and/or proppant prior to placement in the wellbore and/or subterranean formation.

A fracturing design/procedure may include fracturing an entire target zone in a vertical portion of the wellbore from bottom to top, or an entire target zone in a horizontal portion of the wellbore from toe to heel, and there may be no zone left unfractured to improve the ultimate oil or gas recovery. If the entire zone is not fractured as planned (e.g., from bottom to top or from toe to heel or some zone is left unfractured), it may be useful for an operator to know the sequence of fractures or to modify the fracturing design and procedure. Alternatively, in addition to using plugs, the operator may also seal the opened perforations/fractures to fracture the un-opened perforations/unfractured zones, thereby potentially making the fracturing operation costly and risky.

Figure 2:
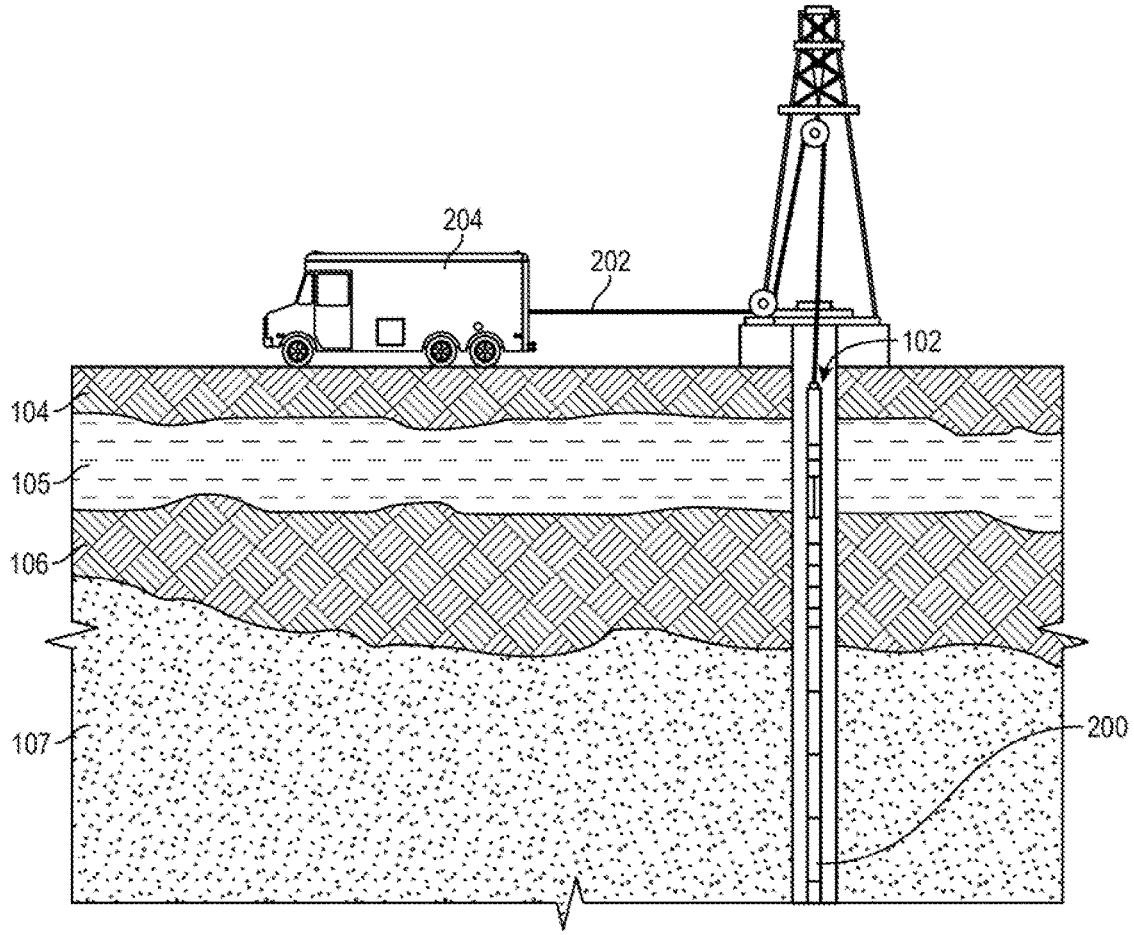
FIG. 2 illustrates a schematic view of a downhole tool in the wellbore, according to an embodiment.

FIG. 2 illustrates a schematic view of a downhole tool 200 in the wellbore 102, according to an embodiment. In at least one embodiment, the downhole tool 200 may include a natural gamma ray detector. In another embodiment, the downhole tool may be or include a pulsed neutron capture (PNC) tool containing a pulsed neutron source. The downhole tool 200 may be run into the wellbore 102 and then obtain/capture measurements before the fracturing procedures and/or after the fracturing procedures. In one example, the downhole tool 200 may be run into the wellbore 102 and obtain measurements before the fracture procedures in the first stage 110, and then again after the fracture procedures in the first stage 110.

As shown, the downhole tool 200 may be raised and lowered in the wellbore 102 via a wireline 202. In other embodiments, the downhole tool 200 may instead be raised and lowered by a drill string or coiled tubing. The data obtained by the downhole tool 200 may be transmitted to, stored in, and/or analyzed by a computing system 204. The computing system 204 may include one or more processors and a memory system. The memory system may include one or more non-transitory computer-readable media storing instructions that, when executed by at least one of the one or more processors, cause the computing system to perform operations. The operations are described below, for example, in FIG. 7.

Figure 3:
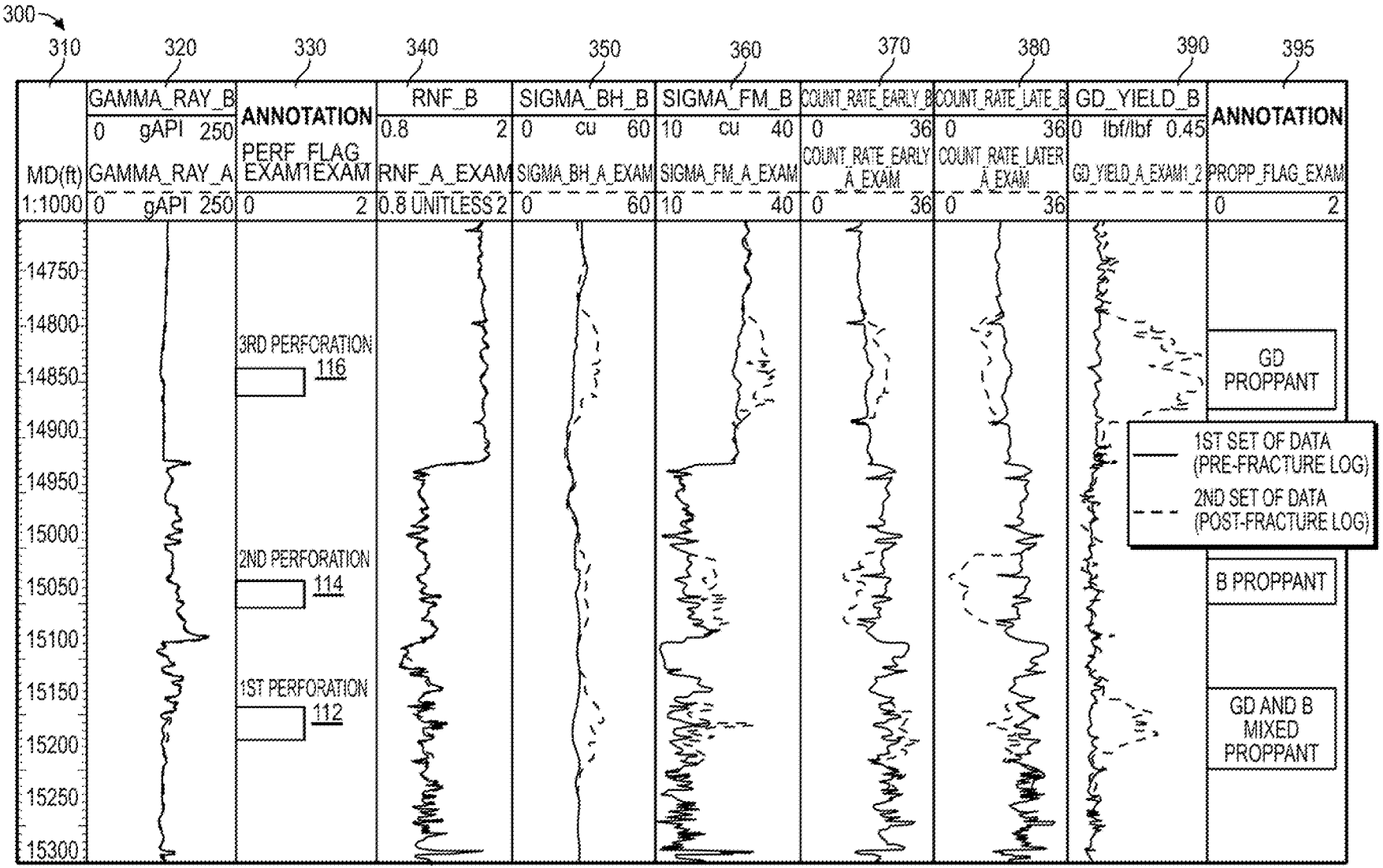
FIG. 3 illustrates a log showing data obtained by the downhole in the wellbore before and after a stage is fractured with a gadolinium-tagged proppant and a boron-tagged proppant, according to an embodiment.

FIG. 3 illustrates a log 300 showing data obtained by the downhole (e.g., PNC) tool 200 in the wellbore 102 before and after the stage 110 is fractured with a gadolinium-tagged proppant and a boron-tagged proppant, according to an embodiment. The log 300 has log columns showing the depths where measurements were recorded/captured 310, the natural gamma ray 320, the perforation intervals 330, the ratio of the capture gamma ray count rate in the PNC logging tool detector nearer the neutron source divided by the corresponding capture gamma ray count rate in a farther spaced detector (RNF) 340, the borehole sigma 350, the formation sigma 360, the detector capture gamma ray count rate in an early time window (e.g., 50 μs to 150 μs from the initiation of the 30 μs wide neutron burst) 370, the detector capture gamma ray count rate in a late time window (e.g., 200 μs to 1000 μs from the initiation of the 30 μs wide neutron burst) 380, the taggant/tracer element (e.g., Gd) yield 390, and a proppant flag 395 indicating where the tracer material is in the downhole formation fractures from the log data analysis. The solid lines represent the data captured before fracturing (i.e., before-fracture logs), and the dashed lines represent the data captured after fracturing (i.e., after-fracture logs).

As shown in FIG. 3, a mixture of a Gd-tagged proppant and a B-tagged proppant is contained in a formation fracture extending from the first set of perforations 112, the B-tagged proppant is contained in a formation fracture extending from the second set of perforations 114, and the Gd-tagged proppant is contained in a formation fracture extending from the third set of perforations 116. The after-fracture count rate in the early time window 370 increases for Gd-tagged proppant filling the formation fracture but decreases for the B-tagged proppant filling the formation fracture. Furthermore, the after-fracture Gd yield 390 increases for Gd-tagged proppant present in the formation fracture, but there is no change for B-tagged proppant present in the formation fracture.

However, it may be difficult to differentiate whether the fracture extending from the first set of perforations 112 contains the Gd-tagged proppant or a mixture of Gd-tagged proppant and the B-tagged proppant, because the after-fracture capture gamma ray count rate 370 can either increase or decrease, depending the relative concentrations of the two tagged proppants in the mixture and the time window selected. If the percentage of B-tagged proppant in the mixture is sufficiently high, the after-fracture count rate in the early time window 370 will decrease, and the user may conclude that the B-tagged proppant is in the mixture, since the only way a decrease can occur is if the B-tagged proppant is present. However, if the percentage of the B-tagged proppant in the mixture is low, the net after-fracture count rate in the early time window 370 may increase or decrease, since the count rate increase caused by presence of the Gd-tagged proppant could more than offset any count rate decrease due to the presence of B-tagged proppant, and the user may not know whether the formation fracture contains a mixture of the two tagged proppants or just the Gd-tagged proppant alone.

Conventional systems and methods can differentiate a Gd-tagged proppant from the B-tagged proppant but cannot differentiate the Gd-tagged proppant from a mixture of the Gd-tagged proppant and the B-tagged proppant, especially when the percentage of the B-tagged proppant in the mixture is low. Accordingly, the systems and methods disclosed herein may enable a user to differentiate the Gd-tagged proppant from a mixture of the Gd-tagged proppant and the B-tagged proppant, even when the percentage of the B-tagged proppant in the mixture is low, as illustrated below.

Figure 4:
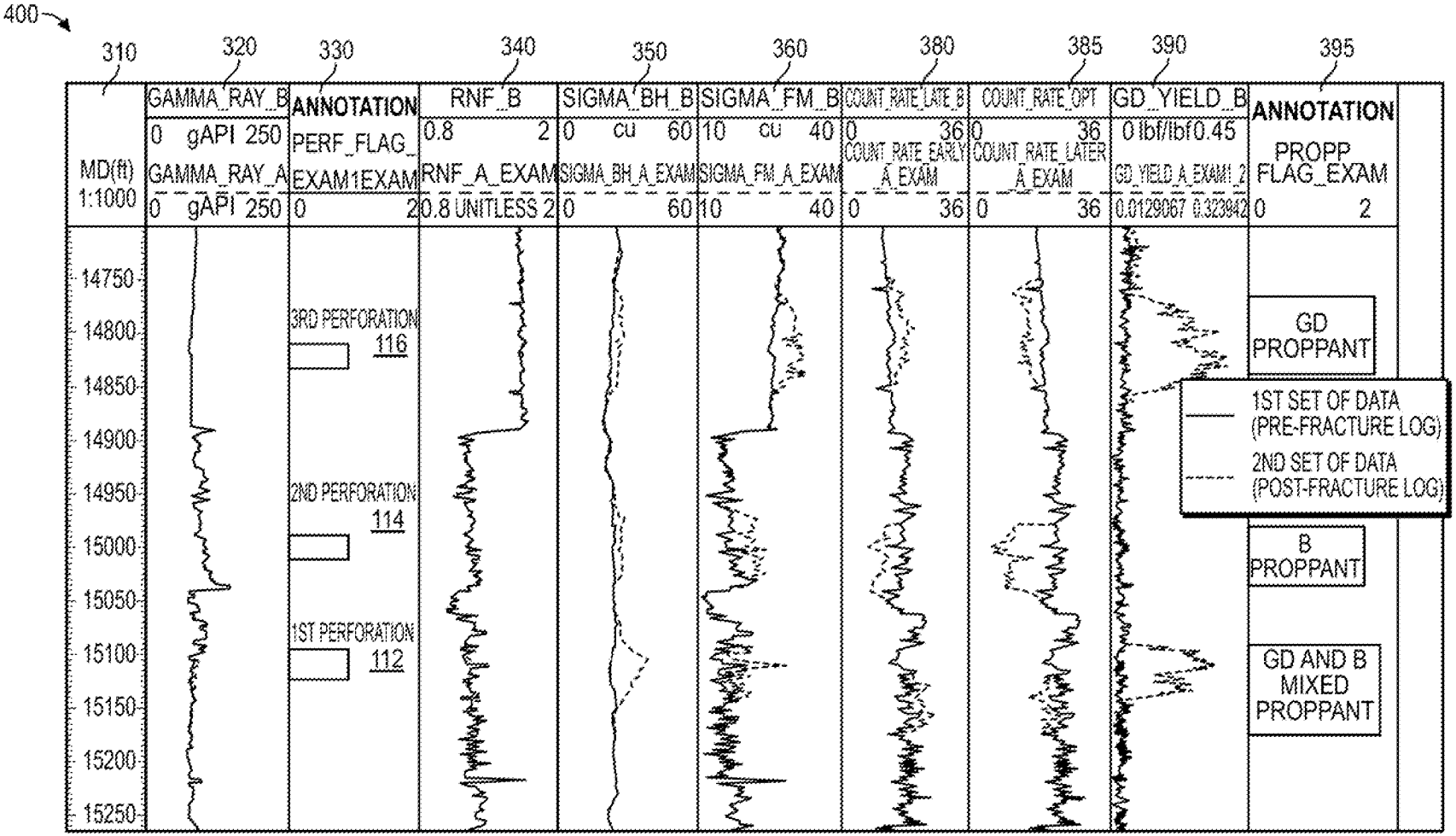
FIG. 4 illustrates another log showing data obtained by the downhole in the wellbore before and after a stage is fractured with a gadolinium-tagged proppant and a boron-tagged proppant, according to an embodiment.

FIG. 4 illustrates another log 400 showing data obtained by the downhole (e.g., PNC) tool 200 in the wellbore 102 before and after the stage 110 is fractured with a gadolinium-tagged proppant and a boron-tagged proppant, according to an embodiment. The log 400 in FIG. 4 is similar to the log 300 in FIG. 3, but includes a new log column 385 representing the PNC detector capture gamma ray count rate log (or C/I log or I/C log) in a predetermined (e.g., optimized) time window, as described below. Column 385 includes before-fracture (solid lines) and after-fracture (dashed lines) detector capture gamma ray count rate logs in the new optimized time window, which is sensitive to the B-tagged proppant but is insensitive to the Gd (or Sm) tagged proppant.

The new column 385 may help differentiate a first scenario (e.g., a Gd-tagged proppant only) from a second scenario (e.g., a mixture of a Gd-tagged and a B-tagged proppant), even when the percentage of B-tagged proppant in the mixture is low. To differentiate the two scenarios, the PNC capture gamma ray count rate log (or C/I log or I/C log) may be analyzed in a predetermined (e.g., optimized) time window 385 after the neutron bursts.

In the optimized time window, the after-fracture capture gamma ray count rate (or C/I log or I/C log) 385 doesn't change relative to the corresponding before-fracture capture gamma ray count rate for one NRT tracer (e.g., Gd or Sm)-tagged proppant, but does decrease for the count rate log or C/I log for the second (e.g., B)-tagged proppant present in the fracture. As a result, if two tracer-tagged proppants are present/detected in the induced fracture, the responses of the capture gamma ray count rate log (or C/I log or I/C log) in the optimized time window 385 may be used together with the borehole sigma log 350, the formation sigma log 360, the count rate log (C/I log, I/C log) in a later time window 380, and/or the Gd (or Sm) yield log 390 to differentiate whether only one tracer-tagged material (e.g. proppant) is present in the fracture or a mixture of two tracer-tagged materials are present in the fracture.

Table 1 illustrates Monte Carlo N-Particle (MCNP) modeling data illustrating the changes between before-fracture measurements and after-fracture measurements of borehole sigma and formation sigma measurements, and capture gamma ray count rate measurements in different time windows relative to the beginning of a 30 μs wide neutron source pulse, with proppants containing three different NRT tracer compounds (e.g., $Gd_2O_3$, $B_4C$, and $Sm_2O_3$) in the induced fracture.

TABLE 1

| Tracer | Concentration | d(Σbh_near) | d(Σfm_near) | d(CR_Near) 50-150 μs | d(CR_Near) 200-1000 μs | d(CR_Near) 400-1000 μs | d(CR_Near) 60-1000 μs |
|---|---|---|---|---|---|---|---|
| $Gd_2O_3$ | 0.4% | 7.8% | 10.0% | 7.3% | −11.5% | −21.0% | −1.0% |
| $B_4C$ | 2.0% | 3.2% | 10.3% | −8.3% | −26.1% | −35.2% | −12.8% |
| $Sm_2O_3$ | 1.5% | 7.4% | 10.0% | 8.0% | −10.5% | −20.0% | −0.1% |

In Table 1, d(Σbh_near) represents the percentage change in the borehole sigma (Σbh) between the before-fracture and after-fracture measurements in the PNC tool near detector, d(Σfm_near) represents the corresponding change in the formation sigma (Σfm), and d(CR_Near) represents the percentage change in the capture gamma ray count rates in the near detector in various time windows relative to the start of the 30 μs wide PNC neutron source pulse. The MCNP modeling of induced fracture results in Table 1 indicate that in the early time window (50-150 microseconds), which occurs from 20 microseconds to 120 microseconds after the end of a neutron pulse (from 0 to 30 microseconds), the observed after-fracture count rates for both Gd and Sm tracers increase, whereas in the two later time windows (from 200-1000 microseconds and from 400-1000 microseconds), the corresponding count rates decrease. This directly indicates that one or more suitable optimized time windows can be developed where the Gd and Sm tracer count rates do not change (i.e., the increase in the count rate in the early part of the optimized time window offsets the decrease in the count rate in the latter part of the time window).

In addition, Table 1 shows that the after-frac boron tracer count rates decrease in all of the time windows. Thus, with one such optimized time window (i.e., the last column on the right in Table 1), the count rate in the 60-1000 microsecond time window is almost totally insensitive (changes less than 1%) to the presence of Gd- (or Sm)-tagged proppant for the typical NRT concentrations, but decreases about 13% for B-tagged proppant (containing 2% $B_4C$) in a 1.0-cm fracture. As a result, the Gd-tagged proppant (or Sm-tagged proppant, which has similar NRT-related properties to Gd-tagged proppant) can be distinguished from the B-tagged proppant when the Gd- and B-tagged proppants are both present in a fracture, because the count rate in this new optimized window 385 is only sensitive to the B-tagged proppant, and the Gd yield measurement 390 is sensitive to only Gd. This is shown in the predicted log responses in FIG. 4. In at least one embodiment, because boron does not emit high energy gamma rays following thermal neutron capture, a boron yield measurement may be impractical. A similar modeling process may be used to develop optimized time window(s) for gravel pack, frac pack, or cementing applications.

In other words, the after-fracture count rate log relative to the before fracture count rate log in the optimized time window 385 does not change for Gd-tagged proppant in the formation fracture (see the third set of perforations 116) but decreases for B-tagged proppant (see the second set of perforations 114). When both the Gd and B tagged proppant are present (see the first set of perforations 112), the capture gamma count rate in the optimized window 385 decreases, but not as much as the situation when only the boron tracer is present, since some of the thermal neutrons from the PNC tool 200 are captured by boron and some by gadolinium. Furthermore, the after-fracture Gd yield log (in log column 390) increases for Gd-tagged proppant present in the formation fracture but there is no change for B-tagged proppant in the formation fracture. These log curves together locate where the Gd-tagged proppant is present, where the B-tagged proppant is present, and where both are present. If the B-tagged proppant had not been present in the first set of perforations 112, the after frac count rate in the optimized window 385 would not have decreased.

The data in FIG. 4 and Table 1 utilizes the fracturing application as an example; however, as discussed below, an optimized time window may also be used for gravel pack, frac pack, and/or cementing applications. However, in these other applications, the optimized time window may differ from the optimized time window in fracturing applications because the borehole geometry and radial location of the tagged material may be different (see Table 2 and FIG. 6 below).

Figure 5:
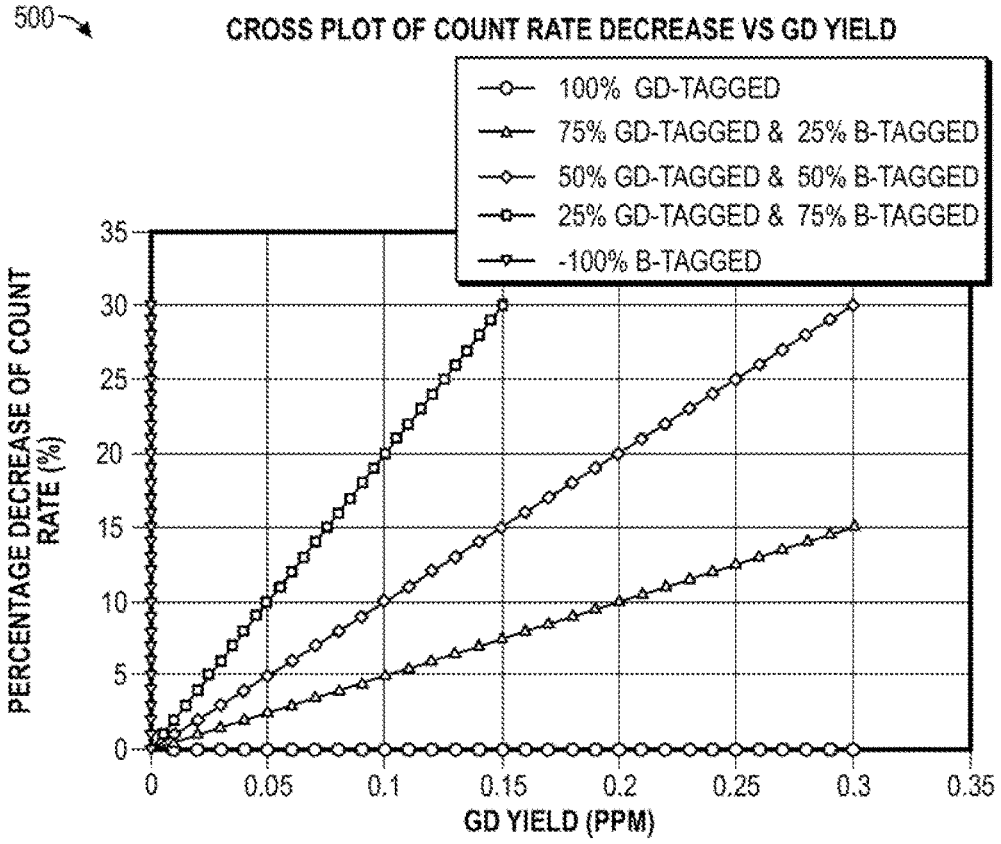
FIG. 5 illustrates a graph showing a cross-plot of the count rate decrease in an optimized time window versus a Gd yield measurement, which provides the percentages of Gd-tagged proppant and B-tagged proppant in the proppant mixture, according to an embodiment.

FIG. 5 illustrates a graph 500 showing a cross-plot of the percentage count rate decrease between before-fracture and after-fracture modeling measurements in the optimized window 385 versus the Gd yield log 390. This crossplot provides a way to determine the percentages of Gd-tagged proppant and B-tagged proppant in the proppant mixture, according to an embodiment. The percentages of the B-tagged proppant and Gd-tagged proppant may be determined when both tagged proppants are present in the formation fracture. The greater the slope of the line, the greater the percentage of B-tagged proppant in the mixture. Furthermore, the magnitude of the Gd yield measurement 390 is directly related to the width of the fracture in the formation, as is the magnitude of the count rate decrease in the optimized window.

Figure 6:
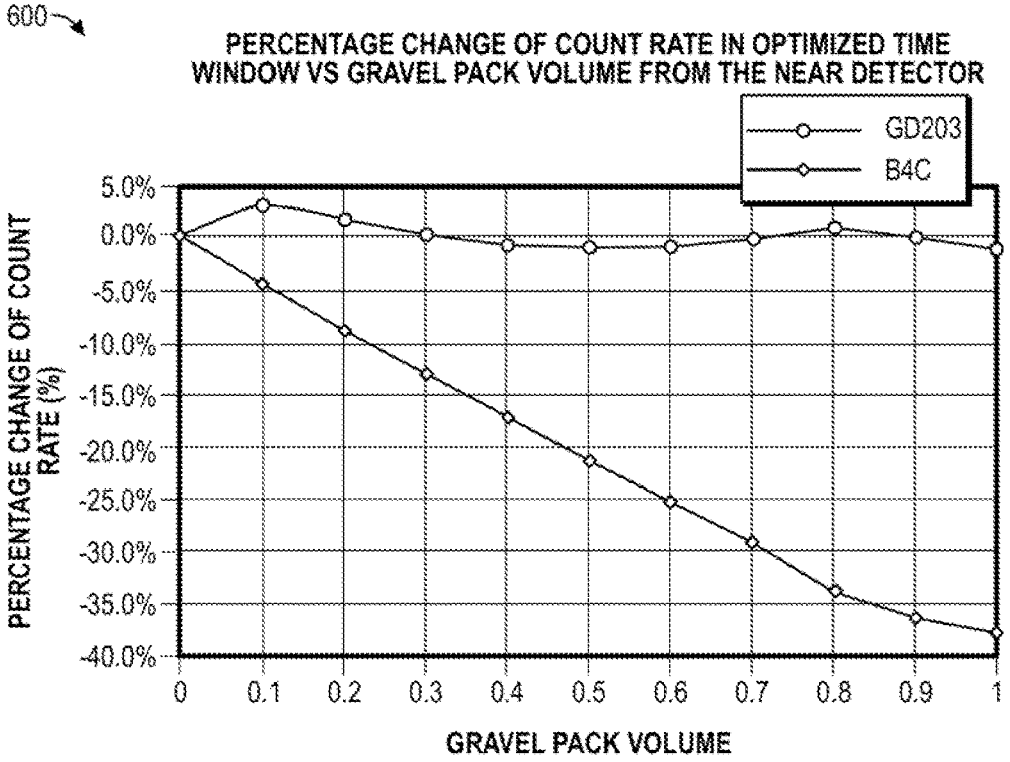
FIG. 6 illustrates a graph showing two-tracer Monte Carlo N-Particle (MCNP) modeling results for a gravel pack (GP) application, according to an embodiment.

FIG. 6 illustrates a graph 600 showing similar two-tracer MCNP modeling results for a gravel pack (GP) application (as opposed to the fracturing application discussed above), according to an embodiment. Table 2 correlates/corresponds to FIG. 6 and illustrates MNCP modeling of the changes of borehole sigma, formation sigma, and the capture gamma ray count rates in different time windows, due to gravel packs containing different NRT tracers.

TABLE 2

| Tracer | Concentration | d(Σbh_near) | d(Σfm_near) | d(CR_Near) 30-70 μs | d(CR_Near) 70-100 μs | d(CR_Near) 100-200 μs | d(CR_Near) 40-100 μs |
|---|---|---|---|---|---|---|---|
| $Gd_2O_3$ | 0.2% | 35.8% | 8.3% | 15.4% | −15.5% | −25.8% | −1.2% |
| $B_4C$ | 1.0% | 20.9% | 3.8% | −17.4% | −30.2% | −35.2% | −21.4% |

By optimizing the time window (the last column on the right in Table 2), the capture gamma ray count rate in that time window (40-100 microseconds), from 10 microseconds to 70 microseconds after a neutron burst (0-30 microseconds) doesn't change significantly (less than −1.2%) for the Gd tagged proppant (containing 0.2% Gd2O3, with various packing volume fractions in the GP annulus). However, the count rate in the optimized window with the Boron-tagged proppant (containing 1% $B_4C$) decreases significantly in proportion to the fraction of the GP annulus containing the pack (e.g., decreases about 21% for B-tagged proppant filling 50% of the GP annulus).

This data shows that the method can also be applied to locate/identify Gd-tagged proppant, B-tagged proppant, and mixtures of Gd-tagged and B-tagged proppant in the gravel pack annulus. The only significant differences in the logging and log interpretation processes for the gravel pack application relative to the fracture application is in the selection of the optimized time window and the tracer concentrations required. By comparing Tables 1 and 2, it can be seen that the optimized time window for a gravel pack application is different from the optimized time window for an induced fracturing application, since the gravel pack (or cement in a cement evaluation application) is located in the borehole region, where the thermal neutrons decay more quickly, and hence earlier time windows need to be utilized.

Figure 7:
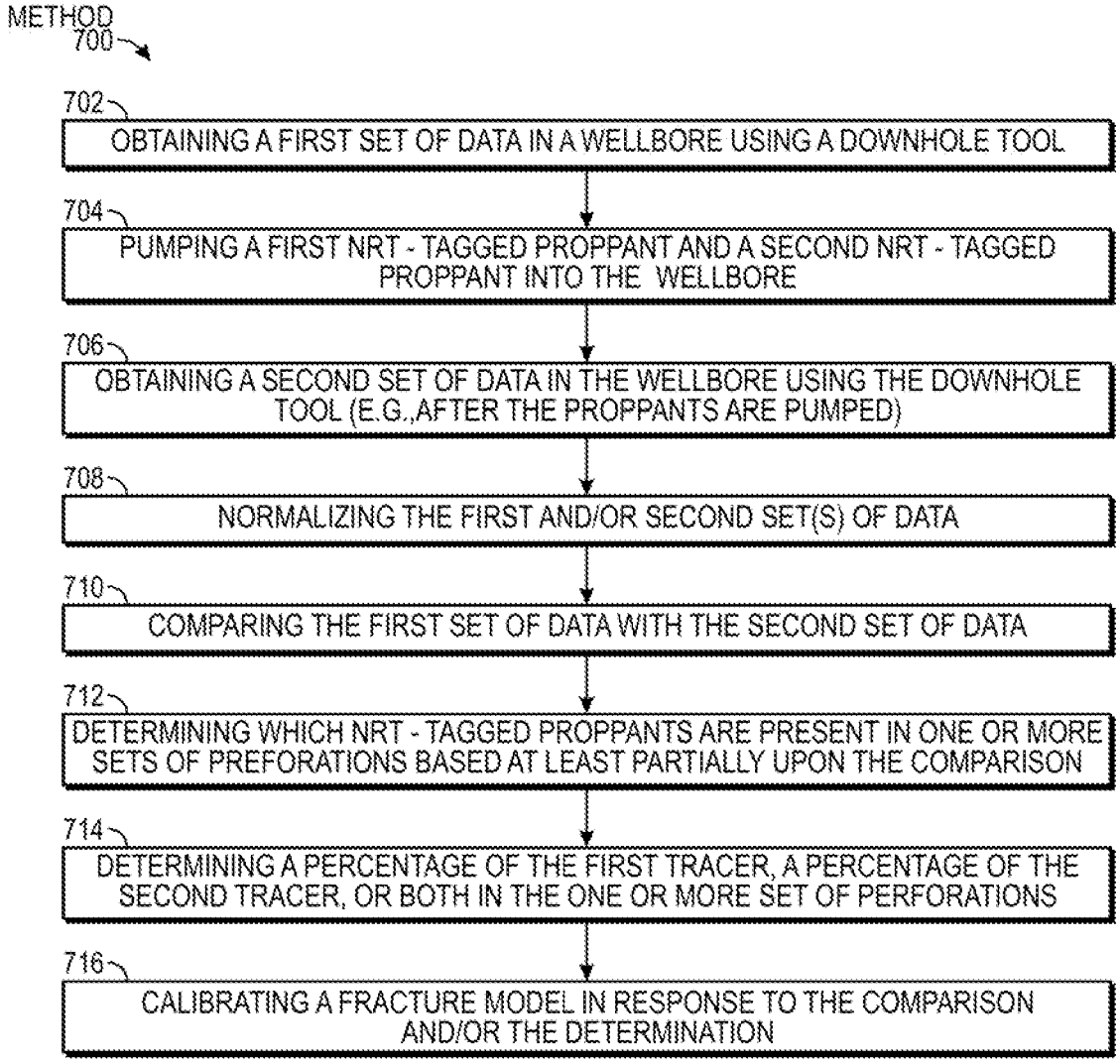
FIG. 7 illustrates a flowchart of a method for evaluating multiple fractures in the wellbore using data obtained by the downhole tool, according to an embodiment.

FIG. 7 illustrates a flowchart of a method 700 for evaluating multiple fractures in the wellbore 102 using data obtained by the downhole tool 200, according to an embodiment. The method 700 may include obtaining (e.g., logging) a first set of data in the wellbore 102 using the downhole tool 200 (e.g., before the proppants are pumped), as at 702. The first set of data may be or include natural gamma ray, borehole sigma, formation sigma, detector capture gamma ray count rates in different time windows (e.g., early time window, late time window, and/or optimized time window), ratios of detector capture gamma ray count rates in different time windows, a taggant/tracer element yield (e.g., Gd yield or Sm yield), temperature, wellbore fluid density, wellbore salinity, or a combination thereof. The data collection may begin below the first set of perforations 112 and continue to above (e.g., 200-300 feet above) the third set of perforations 116.

The method 700 may also include pumping a first NRT-tagged proppant (e.g., the Gd-tagged proppant) and a second NRT-tagged proppant (e.g., the B-tagged proppant) into the wellbore 102 sequentially or simultaneously, as at 704. As described above, the NRT-tagged proppants may be pumped as part of a fracturing procedure, a gravel pack procedure, a frac pack procedure, and/or a cementing procedure. Although it may be intended to pump each of the NRT-tagged proppants into particular perforations 112, 114, 116, in some instances, this may not occur. For example, both the first NRT-tagged proppant (e.g., the Gd-tagged proppant) and the second NRT-tagged proppant (e.g., the B-tagged proppant) may be pumped into the first set of perforations 112. Thus, this method 700 may be used to detect where each NRT-tagged proppant is present.

The method 700 may also include obtaining (e.g., logging) a second set of data in the wellbore 102 using the downhole tool 200 (e.g., after the NRT-tagged proppants are pumped), as at 706. The second set of data may include the same type(s) of data as the first set of data.

The method 700 may also include normalizing the first and/or second set(s) of data, as at 708. Normalizing the first and/or second set(s) of data may account for possible changes inside the wellbore 102 or casing so that the first set of data overlays with the second set of data in the depth interval where there is/are no fracture(s) (e.g., in a depth interval above the first stage 110).

The method 700 may also include comparing the first set of data with the second set of data, as at 710. The comparison may occur after the normalizing. The comparison may include, but is not limited to, comparing the natural gamma ray, borehole sigma, formation sigma, taggant/tracer element yield (e.g., Gd yield), detector capture gamma ray count rates in different time windows (e.g., early time window, late time window, and/or optimized time window), ratios of detector count rates in different time windows, or a combination thereof.

For example, the comparison may include comparing the detector capture gamma ray count rate in the first and second sets of data in an optimized time window after neutron bursts in which the detector capture gamma ray count rate varies less than a predetermined amount for the first tracer and decreases more than the predetermined amount for the second tracer. In another example, the comparison may include comparing the detector capture gamma ray count rate in the first and second sets of data in an optimized time window after neutron bursts in which the detector capture gamma ray count rate varies by less than about 5%, less than about 4%, less than about 3%, less than about 2%, or less than about 1% for the first tracer and decreases by more than about 5%, more than about 10%, more than about 15%, more than about 20%, more than about 25%, more than about 30%, more than about 35%, or more than about 40% for the second tracer.

The method 700 may also include determining which NRT-tagged proppants are present in fractures induced by and/or extending from one or more (e.g., each) of the sets of perforations 112, 114, 116 based at least partially upon the comparison, as at 712. In one example, this may include determining whether fractures induced by and/or extending from one of the sets of perforations (e.g., the first set 112) includes a first NRT-tagged proppant (e.g., Gd- or Sm-tagged proppant) or a combination/mixture of the first NRT-tagged proppant (e.g., Gd- or Sm-tagged proppant) and the second NRT-tagged proppant (e.g., B-tagged proppant), even when the percentage of the B-tagged proppant in the mixture is low. Illustrative comparisons and determinations are discussed above with respect to FIG. 4 and Tables 1 and 2.

When both of the NRT-tagged proppants are detected in fractures induced by and/or extending from a single set of perforations (e.g., the first set of perforations 112), the method 700 may also include determining a percentage of the first tracer (or the first NRT-tagged proppant), a percentage of the second tracer (or the second NRT-tagged proppant), or both in fractures induced by and/or extending from the set of perforations 112, as at 714. The percentages may be based at least partially upon an amount that the detector capture gamma ray count rate 385 decreases and/or an amount that the tracer yield log 390 increases proximate to the set of perforations 112. One illustrative way of determining the percentages is described above with reference to the cross-plot in FIG. 5.

The method 700 may also include calibrating a fracture model in response to the comparison and/or the determination, as at 716. The fracture model may be calibrated to reduce the uncertainties in fracture procedure designs. This may lead to more efficient fracturing procedures and improve the ultimate oil or gas recovery. For example, the lead-in portion of the proppant may be modified to not include a tracer, and only the tail-in portion of the proppant may be modified to include the tracer, or different NRT tracers may be used in the lead-in and tail-in portions. Also, different NRT tracers may be used in different stages of a fracturing procedure, and the results obtained used to optimize future fracturing procedures. In another embodiment, the particles size(s) in the proppant(s) may be varied and placed downhole either sequentially or simultaneously, with the different proppant size particles tagged with different NRT tracers, again with the results utilized to optimize future fracturing operations. Also, the NRT-tagged proppant may be replaced with loose or raw NRT material that is separate and distinct from any proppant or other carrier material(s). For example, the tracer materials disclosed herein may be mixed with any fracturing fluid, cement, gravel and/or proppant prior to placement in the wellbore and/or subterranean formation.

It is understood that modifications to the invention may be made as might occur to one skilled in the field of the invention within the scope of the appended claims. All embodiments contemplated hereunder which achieve the objects of the invention have not been shown in complete detail. Other embodiments may be developed without departing from the spirit of the invention or from the scope of the appended claims. Although the present invention has been described with respect to specific details, it is not intended that such details should be regarded as limitations on the scope of the invention, except to the extent that they are included in the accompanying claims.

What is claimed is:

1. A method for evaluating induced fractures in a wellbore, comprising:

obtaining a first set of data in a wellbore using a downhole tool, wherein the downhole tool comprises a pulsed neutron logging tool;

pumping a first tracer into the wellbore after the first set of data is obtained, wherein the first tracer includes an element selected from the group consisting of gadolinium, boron, and samarium;

pumping a second tracer into the wellbore, wherein the second tracer includes an element selected from the group consisting of gadolinium, boron, and samarium, wherein the second tracer is different than the first tracer, and wherein the first tracer and the second tracer flow into fractures in the wellbore;

obtaining a second set of data in the wellbore using the downhole tool after the first and second tracers are pumped into the wellbore; and comparing the first and second sets of data, wherein comparing the first and second sets of data comprises comparing a detector capture gamma ray count rate in the first and second sets of data in a time window after neutron bursts in which the detector capture gamma ray count rate varies by less than 3% for the first tracer and decreases by more than 5% for the second tracer.

2. The method of claim 1, wherein the second tracer is pumped into the wellbore simultaneously with, or after, the first tracer.

3. The method of claim 1, wherein the first set of data, the second set of data, the comparison of the first and second sets of data, or a combination thereof comprise:

formation sigma data;

borehole sigma data;

detector gamma ray count rate data in two or more different time windows during and/or after neutron bursts;

ratio data of detector gamma ray count rate changes in two or more different time windows during and/or after neutron bursts;

elemental yield data of the first tracer, the second tracer, or both; or a combination thereof.

4. The method of claim 1, further comprising detecting a location of the first tracer based on elemental yield data in the first set of data, the second set of data, the comparison of the first and second sets of data, or a combination thereof, wherein the first tracer comprises gadolinium or samarium, and wherein the second tracer comprises boron.

5. The method of claim 1, further comprising determining, based on the comparison of the first and second sets of data, that the first tracer is present in the fractures proximate to a set of perforations when an elemental yield of the first tracer increases proximate to the set of perforations, wherein the elemental yield of the first tracer is in the first set of data, the second set of data, or both.

6. The method of claim 1, wherein comparing the first and second sets of data comprises comparing a detector capture gamma ray count rate in the first and second sets of data in a time window after neutron bursts in which the detector capture gamma ray count rate varies by less than 1% for the first tracer and decreases by more than 10% for the second tracer.

7. The method of claim 1, wherein comparing the first and second sets of data comprises comparing a detector capture gamma ray count rate in the first and second sets of data in a time window after neutron bursts in which the detector capture gamma ray count rate varies by less than a predetermined amount for the first tracer and decreases by more than the predetermined amount for the second tracer, the method further comprising determining, based on the comparison of the detector capture gamma ray count rate in the first and second sets of data in the time window, that the second tracer is present in the fractures proximate to a set of perforations when the detector capture gamma ray count rate decreases by more than the predetermined amount for the second tracer proximate to the fractures proximate to the set of perforations, wherein the second tracer comprises boron.

8. The method of claim 7, further comprising determining, based on the comparison of the detector capture gamma ray count rate in the first and second sets of data in the time window and based on a comparison of a tracer yield of the first tracer in the first and second sets of data, that the first and second tracers are both present in the fractures proximate to a set of perforations when, proximate to the fractures proximate to the set of perforations:

the detector capture gamma ray count rate decreases by more than the predetermined amount for the second tracer; and the tracer yield of the first tracer increases, wherein the first tracer comprises gadolinium or samarium and the second tracer comprises boron.

9. The method of claim 8, wherein the first tracer and the second tracer are determined to both be present in the fractures proximate to the set of perforations even when a percentage of the second tracer is less than about 50% with respect to a combination of the first and second tracers.

10. The method of claim 8, further comprising determining a percentage of the first tracer, a percentage of the second tracer, or both in the fractures proximate to the set of perforations based at least partially upon an amount that the detector capture gamma ray count rate decreases and an amount that the tracer yield increases, wherein the percentage of the first tracer, the percentage of the second tracer, or both are determined using a cross-plot of the detector capture gamma ray count rate in the window versus the tracer yield.

11. The method of claim 1, wherein the first tracer is incorporated into a first plurality of proppant particulates or first proppant.

12. The method of claim 1, wherein the second tracer is incorporated into a second plurality of proppant particulates or second proppant.

13. A method for designing a hydraulic fracturing procedure, comprising:

obtaining the comparison of the first and second sets of data in accordance with the method of claim 1; and modifying an existing fracturing procedure in response to the comparison of the first and second sets of data.

14. A method for evaluating a gravel pack or cement in a wellbore, comprising:

obtaining a first set of data in a wellbore using a downhole tool, wherein the downhole tool comprises a pulse neutron logging tool;

pumping a first tracer into the wellbore after the first set of data is obtained, wherein the first tracer is not radioactive, wherein the first tracer includes an element selected from the group consisting of gadolinium, boron, and samarium;

pumping a second tracer into the wellbore, wherein the second tracer is not radioactive, wherein the second tracer is different than the first tracer, wherein the second tracer includes an element selected from the group consisting of gadolinium, boron, and samarium, and wherein the first tracer and the second tracer flow into a gravel pack or cement in the wellbore;

obtaining a second set of data in the wellbore using the downhole tool after the first and second tracers are pumped into the wellbore; and comparing the first and second sets of data, wherein comparing the first and second sets of data comprises comparing a detector capture gamma ray count rate in the first and second sets of data in a time window after neutron bursts in which the detector capture gamma ray count rate varies by less than 3% for the first tracer and decreases by more than 5% for the second tracer.

15. The method of claim 14, wherein the second tracer is pumped into the wellbore simultaneously with, or after, the first tracer.

16. The method of claim 14, wherein the first set of data, the second set of data, the comparison of the first and second sets of data, or a combination thereof comprise:

borehole sigma data;

detector gamma ray count rate data in two or more different time windows during and/or after neutron bursts;

ratio data of detector gamma ray count rate changes in two or more different time windows during and/or after the neutron bursts;

elemental yield data of the first tracer, the second tracer, or both; or a combination thereof.

17. The method of claim 14, further comprising detecting a location of the first tracer based on elemental yield data in the first set of data, the second set of data, the comparison of the first and second sets of data, or a combination thereof, wherein the first tracer comprises gadolinium or samarium, and wherein the second tracer comprises boron.

18. The method of claim 14, wherein the first tracer is incorporated into a first plurality of proppant particulates or first proppant.

19. The method of claim 14, wherein the second tracer is incorporated into a second plurality of proppant particulates or second proppant.

20. The method of claim 14, wherein the first set of data comprises detector gamma ray count rate data in a first time window after neutron bursts and the second set of data comprises detector gamma ray count rate data in a second time window after neutron bursts, wherein the second time window is different than the first time window.

* * * * *